US010062996B2

(12) United States Patent
Bello et al.

(10) Patent No.: US 10,062,996 B2
(45) Date of Patent: Aug. 28, 2018

(54) METHODS AND APPARATUS FOR PREVENTING OXIDATION OF AN ELECTRICAL CONNECTION

(75) Inventors: Nolan Bello, North Aurora, IL (US); Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 1930 days.

(21) Appl. No.: 13/306,570

(22) Filed: Nov. 29, 2011

(65) Prior Publication Data

US 2013/0137316 A1 May 30, 2013

(51) Int. Cl.

| | |
|---|---|
| ***H01R 13/03*** | (2006.01) |
| ***B22F 1/00*** | (2006.01) |
| *H01R 4/34* | (2006.01) |
| *H01B 1/12* | (2006.01) |

(52) U.S. Cl.

CPC ..... *H01R 13/03* (2013.01); *H01B 1/122* (2013.01); *H01R 4/34* (2013.01)

(58) Field of Classification Search

CPC ..... H01R 13/03; H01R 4/34; H01R 43/16; H01B 1/22; B22F 1/0059; B22F 2998/00; B22F 2998/10; B28K 2995/0005

See application file for complete search history.

(56) References Cited

U.S. PATENT DOCUMENTS

| | | | |
|---|---|---|---|
| 4,578,215 | A | 3/1986 | Bradley |
| 5,744,197 | A | 4/1998 | Van Eck |
| 6,515,231 | B1 | 2/2003 | Strbech et al. |
| 7,905,964 | B2 | 3/2011 | Witteler et al. |

FOREIGN PATENT DOCUMENTS

| | | | |
|---|---|---|---|
| EP | 2371909 | A1 | 10/2011 |
| WO | 2010/132766 | A2 | 11/2010 |

OTHER PUBLICATIONS

Braunovic, Milenko, V. V. Konchits, and Nikolaĭ Konstantinovich. Myshkin. "Introduction to Electrical Contacts." Introduction. Electrical Contacts: Fundamentals, Applications and Technology. Boca Raton: CRC, 2007. 3-6.*

Pillon, Lilianna Z. "Conventional Refining." Interfacial Properties of Petroleum Products. Boca Raton: Taylor & Francis, 2008. 68.*

(Continued)

*Primary Examiner* — Colleen P Dunn
*Assistant Examiner* — Anthony M Liang
(74) *Attorney, Agent, or Firm* — Greenberg Traurig, LLP

(57) ABSTRACT

A malleable wax-based antioxidant is provided for use between two electrical connectors. To form the example antioxidant, a wax-base is melted and particles, such as, for example, zinc particles, are provided in suspension with the melted wax. The suspension is then cooled and formed into a shape by, for example, molding, extrusion, die cutting, or other suitable forming method. The antioxidant remains viscose under normal operating temperatures of the electrical connector to avoid oozing and/or running out of the antioxidant, thus better preventing oxidation of the connector. The particles keep the connections running cool, particularly with aluminum to aluminum connections.

5 Claims, 3 Drawing Sheets

(56) References Cited

OTHER PUBLICATIONS

Sequeira, Avilino. "Crude Oils, Base Oils, and Petroleum Wax." Lubricant Base Oil and Wax Processing. New York: M. Dekker, 1994. 39.*
NIIR Board of Consultants & Engineers. "Microcrystalline Waxes." The Complete Technology Book on Wax and Polishes. Delhi, India: Asia Pacific Business, 2007. 563-64.*
Termeer, Chris. "Finished Products & Standards." Fundamentals of Investing in Oil and Gas. Chris Termeer Publishing, 2013.*
Slade, Paul G. "Aluminum and Its Alloys." Electrical Contacts: Principles and Applications. 2nd ed. Boca Raton: CRC Press, 2013. 243.).*
Ohring, Milton. "Polymer Processing." Engineering Materials Science. San Diego: Academic, 1995. 408.*
Porter, Frank. "Zinc Dust and Compounds." Zinc Handbook: Properties, Processing, and Use in Design. New York: M. Dekker, 1991. 582.*
ISA/US, Int. Search Report and Written Opinion of PCT Appln. No. US12/66852, dated Feb. 26, 2013, 7 pgs.

* cited by examiner

METHODS AND APPARATUS FOR PREVENTING OXIDATION OF AN ELECTRICAL CONNECTION

FIELD OF THE DISCLOSURE

The present description relates generally to electrical connections and more particularly, to methods and apparatus for preventing oxidation of an electrical connection.

BACKGROUND OF RELATED ART

The electrical industry uses an antioxidant to help keep electrical connections from getting oxidation in-between the conductive surfaces of the connections. An antioxidant may be particularly important when the connection is made through an aluminum to aluminum or an aluminum to copper connection.

In particular, most metals (with a few exceptions, such as gold) oxidize freely when exposed to air. In the specific case of aluminum, aluminum oxide is not an electrical conductor, but rather an electrical insulator. Consequently, the flow of electrons through the oxide layer can be greatly impeded. However, because the oxide layer is only a few nanometers thick, the added resistance is not noticeable under most conditions. When an aluminum wire is terminated properly, the mechanical connection breaks the thin, brittle layer of oxide to form an excellent electrical connection. Unless this connection is loosened, there is no way for oxygen to penetrate the connection point to form further oxide, and thus the connector operates with little change.

However, as is typically the case, this connection does loosen over time, and once oxygen penetrates the connection point to form an oxide, the electrical connection may be compromised. For instance, aluminum, steel, copper, each expand and contract at different rates under thermal load, so connections utilizing multiple metals can become progressively looser over time. In one instance, the expansion/contraction cycle results in the connection loosening slightly, overheating, and allowing intermetallic steel/aluminum oxidization to occur between the conductor and the screw terminal. This may result in a high-resistance junction, leading to overheating.

Another issue is the joining of aluminum wire to copper wire. As aluminum and copper are dissimilar metals, galvanic corrosion can occur in the presence of an electrolyte and these connections can become unstable over time.

To prevent oxidation, many types of antioxidants have been developed in the industry. These antioxidants, however, are typically either a grease or gel-like material. For example, in one instance, a twist-on connector, such as a Twister® Al/Cu Wire Connector, available from Ideal Industries, Inc., Sycamore, Ill., has been designed for the purpose of joining aluminum to copper wire. This twist-on wire connectors use a special polypropylene, zinc plated steel, antioxidant grease to prevent corrosion of the connection. In another example similarly available from Ideal Industries, a grease-like antioxidant includes a polybutene (<80% wt), zinc dust (20% wt), and silicon dioxide (<5% wt).

While the prior antioxidants are oftentimes suitable for their intended purposes, there remains a need for a malleable antioxidant for use with some electrical connections.

DETAILED DESCRIPTION

In particular, in the example antioxidant disclosed herein, a malleable wax-based antioxidant is provided for use between two electrical connectors. To form the example antioxidant, a wax base is melted and metal particles, such as, for example, zinc particles, are provided in suspension with the melted wax base. The wax suspension is cooled and formed into a shape by, for example, molding, extrusion, die cutting, and/or other suitable forming method. In use, the zinc particles keep the connections running cool, particularly with aluminum to aluminum connections.

The following description of example methods and apparatus is not intended to limit the scope of the description to the precise form or forms detailed herein. Instead the following description is intended to be illustrative so that others may follow its teachings.

Figure 1:
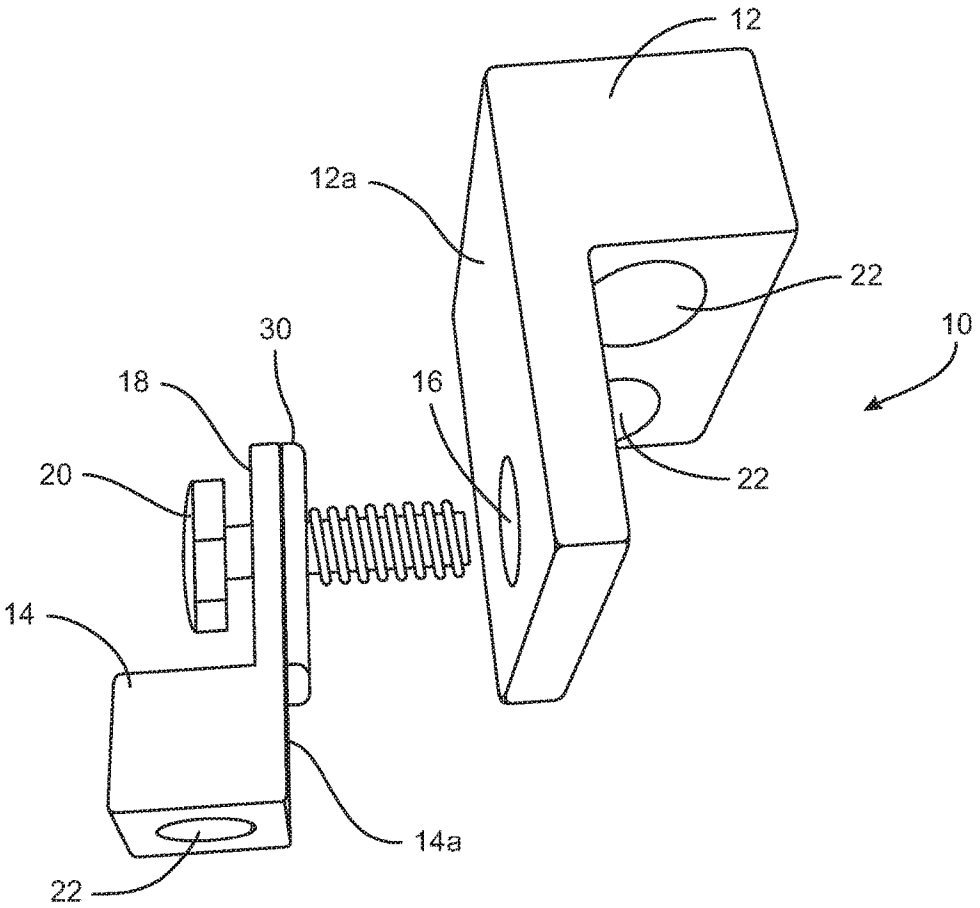
FIG. 1 is a front perspective view of an example electrical connection with an example antioxidant of the present disclosure prior to assembly of the connection.

Referring now to FIG. 1, an example electrical connector 10 is illustrated. In the illustrated example, the electrical connector includes a first connector 12, and a second connector 14, such as for example a common mechanical lug. The first and second connectors 12, 14 are each configured with a mating contact surface 12*a*, 14*a*, respectively, and in the illustrated examples, each contact surface 12*a*, 14*a* defines an aperture, 16, 18, such as a threaded aperture, for receiving a fastener 20 such as a threaded screw. In operation, the fastener 20 mechanically couples the connector 12 and the connector 14 such that the surfaces 12*a* and 14*a* are brought into contact and therefore into electrical communication. It will be appreciated by one of ordinary skill in the art that in at least one example, the connectors 12, 14 comply with any applicable standards, including, for instance, UL 486B, entitled "Wire Connectors for Use with Aluminum Conductors," and incorporated herein by reference in its entirety.

Continuing with the illustrated example, each of the example connectors 12, 14 includes at least one wire insert 22 adapted to accept a wire connector (not shown) such as an aluminum and/or copper wire. Each of the wire inserts 22 includes a fastener 24 such as a set screw to retain an inserted wire connector in the wire insert 22.

As previously noted, the example connectors 12, 14, may be any suitable electrical connector including a mechanical lug, such as a dual-rated (aluminum/copper) two-barrel mechanical connector 12 and/or a single-barrel mechanical connector 14, comprising a high strength aluminum alloy. It will be appreciated, however, that the connectors 12, 14 may be constructed of any suitable material, including, for example, a copper material as desired. As previously noted, the connectors 12, 14 are electrically coupled and in at least one example, are UL listed at 600V and are acceptable for use through 2000V.

Figure 3:
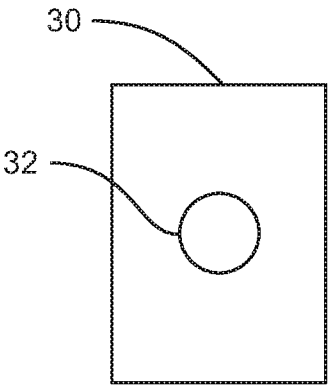
FIG. 3 is a top plan view of an example shape of the example antioxidant of FIG. 1.
Figure 2:
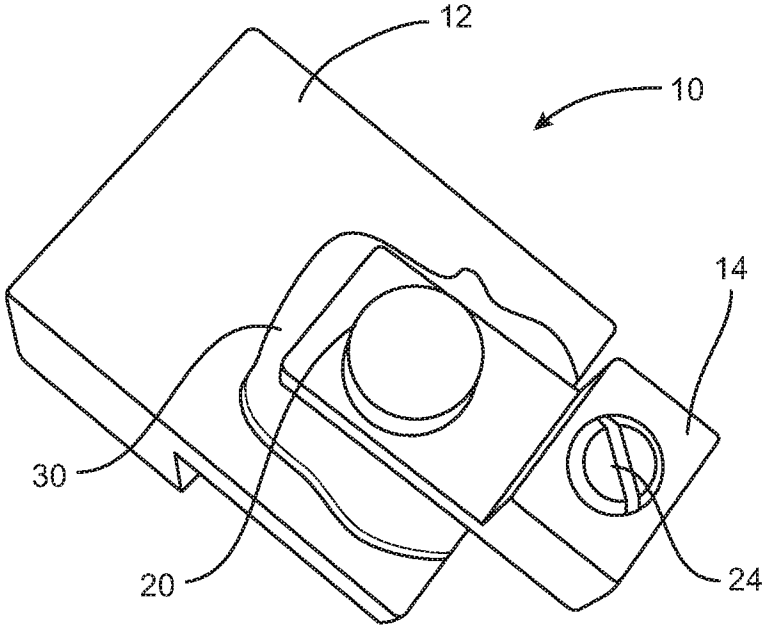
FIG. 2 is a bottom perspective view of the example electrical connection of FIG. 1 after assembly, showing the flow characteristics of the example antioxidant.

To prevent oxidation between the two conductive surfaces the example connector 10 includes an antioxidant 30. In this example, the antioxidant 30 is a die-cut wafer sized to insert utilized during assembly of the electrical connector to sufficiently cover the portions of the mating contact surfaces 12*a*, 14*a* that are brought into contact when the electrical connector 10 is assembled. As illustrated in FIG. 3, the example antioxidant 30 is a provided as a separate element that may be inserted between the two connectors 12, 14 during assembly. As shown, the antioxidant 30 is provided with an aperture 32 sized to allow passage of the fastener 20 therethrough. It will be understood that the size of the aperture 32 (if present) may vary as desired, and due to the malleable nature of the antioxidant 30, the aperture 32 may be smaller than the outer perimeter of the fastener 20 to provide an added assurance of a sufficient seal against the surface of the fastener 20 when the electrical connector is assembled.

As mentioned, the example antioxidant 30 is a wax-based antioxidant which prevents oxidation and helps to keep the electrical connections between the two electrical connectors 12, 14 operating at an optimal level. Specifically, the antioxidant 30 comprises a wax base, such as a material similar to beeswax and/or a microcrystalline wax impregnated with metal particles in suspension, such as for example, a powdered zinc. The percentage of metal particles suspended in the wax base is preferably about 10% to 95% by weight of the suspension.

In one instance, the wax base is a wax material available from The International Group, Inc., of Wayne, Pa., and provided under the product number 5799A. In determining the wax base, it is preferable that the melting temperature of the wax base be relatively high so that the wax does not melt under normal operating temperatures of the electrical connectors under load. This melting temperature can be readily obtained by one of ordinary skill in the art.

With the example material, the drop melting temperature of the chosen wax base is approximately about 73° C. to 81° C. The example wax base also includes an oil content of less than approximately 2.5% by weight, and has a needle penetration of approximately about 20 dmm to 30 dmm at 25° C. Because of these properties, the wax base does not melt and/or flow under normal operating conditions and the antioxidant 30 does not easily "run out" or "ooze" all over the electrical connectors 12, 14 under normal operating circumstances. In particular, the kinematic viscosity of the example wax base is between approximately 13.0 centiStokes (cSt) and 17.0 cSt at 100° C. Beneficially, with the example viscosity, the antioxidant 30 remains malleable and can be manipulated like clay to conform to any desired shape including the shape of the mating surfaces, etc.

Figure 4:
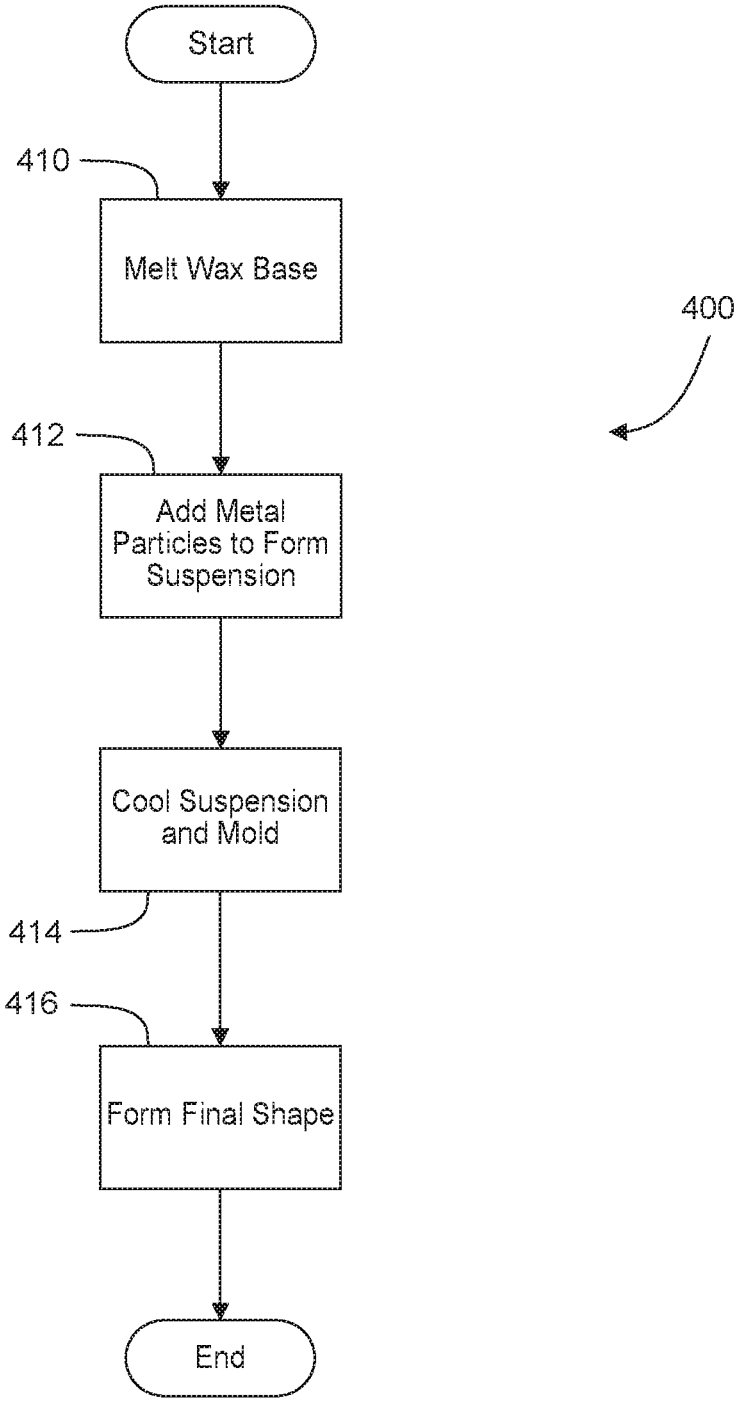
FIG. 4 is a flowchart of an example process of making the antioxidant of the present disclosure.

Turning to FIG. 4, an example manufacturing process 400 suitable for us in producing the antioxidant 30 is shown. The process 400 begins by melting the wax base at a block 410. As previously noted, to melt the example wax base, the material is heated to a temperature above about 73° C. to 81° C. Once the wax base is melted, the process 400 continues at a block 412, where a plurality of metal particles is added to the melted wax to form a suspension. In this example, the metal particles are zinc particles, micro-pulverized to the consistency of a powder. It will be appreciated, however, that the metal particles may be any suitable particle and/or combination of particles including other metals and/or non-metals alike. The example suspension contains about 10% to 95% by weight of the metal particles.

After mixing, the suspension is allowed to cool at a block 414. Before, during, and/or after the cooling period, the suspension may be molded, extruded, and/or otherwise formed into a particular shape. In this example, the cooling suspension is poured into a mold or otherwise formed into a sheet or web. Once cooled sufficiently, the final shape of the antioxidant 30 may be formed at a block 416. It will be appreciated that the final shape may be any suitable shape, including a plug, sphere, cylinder, torus, disk, washer, square, rectangle, etc. It will be further appreciated that the final shape may be custom created by the user, and/or other entity during installation and/or the manufacturing process. Additionally, as noted previously, the final shape may be formed to define and/or include an aperture(s) as desired.

In use, the antioxidant 30, is utilized between the two electrical connectors 12, 14, as illustrated. For example, in one instance, the antioxidant 30 is formed to be rectangular in shape and to include the aperture 32. The antioxidant 30 is placed between the two electrodes 12, 14 by an end-user and the connectors 12, 14 and the contact surfaces 12*a*, 14*a* are brought together in any suitable manner, including, for example, by tightening the fastener 20. Because the antioxidant 30 is malleable, the material will flow between the contact surfaces 12*a*, 14*a* during tightening, to cover the contact surfaces 12*a*, 14*a* and prevent oxidation regardless of whether the connection between the connectors 12, 14 loosens slightly as is typical over time. Furthermore, because the antioxidant 30 is malleable, the shape of the antioxidant 30 may be modified before placement (e.g. like molding clay) between the electrical connectors 12, 14 as desired to ensure a proper coating of the antioxidant 30 over the contact surfaces 12*a*, 14*a*. For instance, in one example, the antioxidant 30 may be shaped into a ball and/or other shape and utilized to fill a pocket for a wire with the antioxidant 30 such that insertion of the wire into the pocket sufficiently coats and/or covers the wire. Furthermore, it will be appreciated that because the normal operating temperature of the electrical connection is below the melting point of the wax base, and thus the melting point of the suspension itself, the antioxidant will not flow, ooze, and/or otherwise run out over time, ensuring that the contact surfaces 12*a*, 14*a* will not be exposed over time.

While the example antioxidant 30 is illustrated as connecting a pair of mechanical lugs, it will be understood that the antioxidant may be utilized in any suitable manner, to connect any suitable electrical connector as desired, including for example, between wires and the electrical lug as well. Additionally, while the example antioxidant 30 is illustrated as a wafer-shaped insert, the shape, thickness, and/or form of the antioxidant may vary as desired. Still further, the choice of materials in the antioxidant (e.g., the choice of a wax base and/or the type of suspended particle) may vary without departing from the scope of the present disclosure. Finally, while not illustrated in the present disclosure, the antioxidant may be provided with various other inert and/or active ingredients to enhance and/or otherwise supplement the characteristics of the present antioxidant as desired.

Accordingly, although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A method of forming an antioxidant material for use between two electrical connectors comprising:

melting a wax base, wherein the wax base has a melting temperature of at least about 73.0° C., a kinematic viscosity of between about 13.0 cSt and 17.0 cSt at 100° C., an oil content of less than about 2.5% by weight, and a needle penetration depth of the wax base is about 20 dmm to 30 dmm at 25° C.;

adding metal particles to the melted wax to form a suspension, wherein the metal particles are zinc and the suspension includes about 10% to 95% by weight of the metal particles;

cooling the suspension to form a malleable solid; and forming the malleable solid into a shape suitable for placement between the two electrical connectors.

2. A method as defined in claim 1, further comprising forming an aperture in the shape.

3. A method as defined in claim 2, wherein the aperture is sized to allow a fastener coupling the two electrical connectors to pass through the aperture.

4. A method as defined in claim 1, wherein the shape is formed through at least one of an extrusion or die-cut process.

5. A method as defined in claim 1, wherein at least one of the electrical connectors is a wire.

* * * * *